United States Patent [19]

Bruun et al.

[11] Patent Number: 4,806,224

[45] Date of Patent: Feb. 21, 1989

[54] ELECTROLYTIC PROCESS

[75] Inventors: Dieter Bruun, Neu-Anspach; Wolfgang Dietz, Bruchkobel; Klaus-Jurgen Muller, Frankfurt; Conrad H. H. Reynvaan, Frankfurt am Main, all of Fed. Rep. of Germany

[73] Assignee: Deutsche Carbone Aktiengesellschaft, Frankfurt am Main, Fed. Rep. of Germany

[21] Appl. No.: 20,357

[22] Filed: Mar. 2, 1987

[30] Foreign Application Priority Data

Jul. 7, 1986 [EP] European Pat. Off. ..... 86109265.9

[51] Int. Cl.[4] ..... C25D 21/10; C25D 21/12

[52] U.S. Cl. ..... 204/222; 204/261; 204/273; 204/275

[58] Field of Search ..... 204/222, 273, 275, 261

[56] References Cited

U.S. PATENT DOCUMENTS

| | | | |
|---|---|---|---|
| 2,744,860 | 5/1956 | Rines | 204/222 X |
| 3,351,539 | 11/1967 | Branson | 204/222 X |
| 3,511,765 | 5/1970 | Beck et al. | 204/222 X |
| 3,699,014 | 10/1972 | Eisner | 204/222 X |
| 4,049,512 | 9/1977 | Tolle, Jr. | 204/222 X |
| 4,125,447 | 11/1978 | Bachert | 204/222 |
| 4,619,749 | 10/1986 | Nusbaum | 204/273 X |
| 4,675,254 | 6/1987 | Shuster et al. | 204/275 X |

*Primary Examiner*—Donald R. Valentine

*Attorney, Agent, or Firm*—Oldham & Oldham Co.

[57] ABSTRACT

An electroltytic process is described by which in order to increase the depletion factory, the material coefficient of the electrolyte passing through an electrolytic cell is increased along the direction of the electrolytic flow.

7 Claims, 2 Drawing Sheets

ELECTROLYTIC PROCESS

This invention relates to an electrolytic process wherein an electrolyte is passed through an electrolytic cell thereby increasing the material transport coefficient by introducing mechanical energy.

In order to obtain electro-mechanical reactions, for instance in aqueous solutions, most diversified embodiments of electro-chemical cells are employed: in cases of smaller concentrations for instance cells including a solid bed of graphite granulate, metal wool or metal foam or staples of expanded metal. In cases of larger concentrations, plate cells are generally used. It has also been known that the efficiency of a cell, particularly of a plate cell can be improved by increasing the material transport coefficient. This is for instance reached in that the agent to be treated is circulated with a high speed through the cell and the liquid treated is subsequently passed on, charge-wisely, or in that the system is added a small volume flow before the cell and a correspondingly small volume flow is removed after the cell. Other methods to increase the material transport coefficient include mechanical stirring or the introduction of gas into the cell. The up-moving gas bubbles increase the material transport coefficient, too. Very often, too, the electrode is moved in order to so obtain a higher relative movement of electrolyte and electrode. This may be accomplished by vibrating the electrode, by creating a turbulence about a solid bed or by rotating electrodes. It has also been known to disturb and break up the barrier layer in a plate cell by mechanical movement of particles or other bodies and to so increase the material transport coefficient.

The use of ultrasound has been known as well. It has furtheron been known that the latter method has not only the advantage of an increased material transport coefficient but additionally reduces the gas bubble coating of the electrode surface in that the gas bubbles are better removed from the surface.

A good survey on the problems in this connection together with suggestions for a solution based on various movement principles has been given in a paper published in "Neue Huette", September 1982, pp. 317–322. A further paper published in "Erzmetall", 1974, pp. 107–114, describes a detailed suggestion for a solution. It describes an electrolytic process wherein the electrolyte is passed through the electrolytic cell. The present invention starts from this state of the art.

Further reference is made to a comprehensive paper published in "Quarterly Reviews" 7/1953), pp. 84–101.

While in the two first-mentioned publications the material transport coefficient is increased by introducing mechanical energy, the whole electrolytic cell has, in the prior art, been subjected to the mechanical vibrations or other means for the increase of the material transport coefficient without making any difference as to the electrolytic flow in the electrolytic cell.

In the case of solid bed cells as well as of plate cells, one has, independently from the material transport coefficient, to cope with the problem that the cathodic as well as the anodic overvoltage does not remain constant from the cell inlet to the cell outlet. (In the following we shall refer to an electro-chemical cell as a unit where the cathode and the anode consist of one piece and are not segmented in the direction of the electrolytic flow so that various potentials can be adjusted.

The reason for the cathode and the anodic overvoltage is that the cell voltage is equal at cell inlet and cell outlet the current density however is, generally, much smaller at the cell outlet. If now the resistivity of the treated solution remains substantially equal from the cell inlet to the cell outlet, as is generally the case, the portion of the ohmic voltage drop changes with the decreasing current density. Since the cell voltage is constant, the overvoltages must necessarily increase. This is described by the equation $$\text{Cell coltage} = \text{cathodic overvoltage} + \text{anodic overvoltage} + \text{local cell resistivity} \times \text{local current.}$$

The change of the electrode overvoltages can be very disturbing because a range will be reached at the cell outlet wherein undesired side reactions take place at the electrode. In most of the cases, this takes place at the cathode, for instance the production of hydrogen.

It has been known that when using solid bed cells, this problem can be eased in that at the cell outlet a larger solid bed volume is provided or the packing density is somehow raised, for instance by smaller granulation of the granulate employed or a stronger compression of a stuffing with metal wool or metal foam. In this way, the locally flowing current can be increased and the share of the ohmic voltage drop is again somewhat larger. (Compare for instance German Patent Specification No. 2,622,497 or 3,532,573).

It is therefore the aim of the present invention to provide an electrolytic process of the kind mentioned in the beginning where the current density at the cell outlet is sensibly increased while no undesired side reactions are experienced.

In order to solve this problem, the invention is characterized in that the increase of the material transport coefficient along the direction of the electrolytic flow essentially grows.

The idea underlying the present invention is to be seen in that the current density at the cell outlet is increased in that, at that location, the material transport coefficient is increased as compared to the cell outlet for instance in that the electrolyte is subjected to pressure waves the intensity of which is stronger at the cell outlet than at the cell inlet. It is obvious that in a vessel filled with a liquid and open at the top, the housing of which is vibrated, for instance by percussions, the amplitude of the vibrations is greater in the upper area than in the lower area where the side plates are held together by a bottom. If now an electro-chemical cell consists for instance of a rectangular box, wherein the electrodes are suspended as plates and if now such box is vibrated from the outside by vibrators, the amplitude of the vibrations is greater in the upper area of the box than in the lower. If now the cell inlet is provided at the lower portion of the box and the cell outlet at the upper portion, the material transport coefficient may in this way be influenced along the direction of the electrolytic flow: it essentially increases. In this way, the gas bubble formation at the cell outlet can be reduced or completely avoided.

In this way, it is now possible to obtain a greater depletion factor in one individual cell while no gas generation at the electrodes is experienced. Undesired side reactions are in this way avoided. In many reactions one can expect that when gas bubble coating of the electrode surface begins, the electro-chemical reaction will almost completely be stopped.

The depletion ratio obtainable (=inlet concentration divided by outlet concentration) will then essentially be determined by up to which concentration the generation of gas bubbles in a cell can be avoided by a side reaction. By means of the process here described, a considerable advantage may be obtained as will be shown by the following calculation.

Generation of gas bubbles occurs if the difference of the current density at the cell inlet and at the cell outlet exceeds a certain value G. This current density is proportional to the product of material transport coefficient and concentration. If the values for the cell inlet are referred to by index G, the values for the cell outlet by index 1, the material transport coefficient by K and the concentration by C, the following unbalanced equation has to be fulfilled so that no undesired side reactions occur $$G > K0 \times C0 - K1 \times C1$$

If it is possible to obtain that the ratio K0:K1=1:2, the possible C1, the outlet concentration, will obviously be half the amount as compared to the case where K0=K1. That means that the obtainable final concentration may be halved once more. The change of the material transport coefficient may also be very much larger and a correspondingly stronger reduction of the outlet concentration will then be possible.

The invention will now be explained in more detail based on an example from which further important features can be taken.

Figure 1:
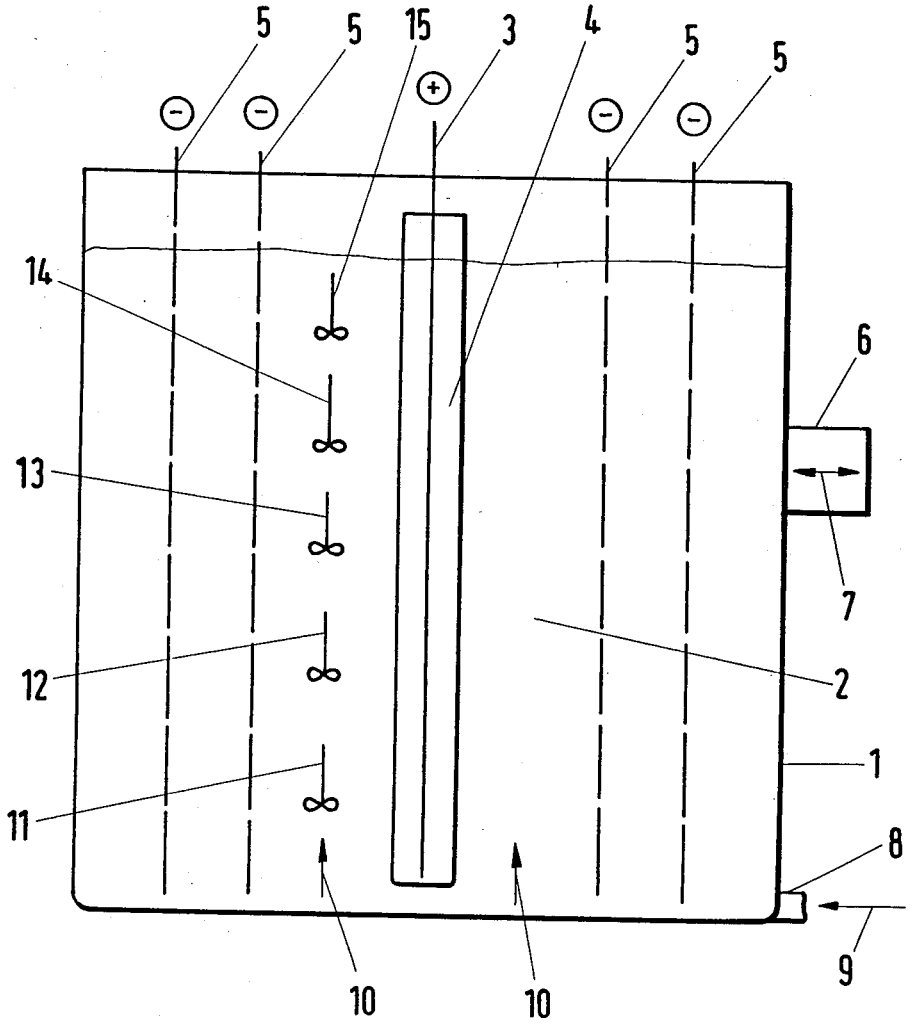
FIG. 1 is a schematic view of an electrolytic cell to explain the principle of the electrolytic process according to the invention.

FIG. 1 shows a vessel 1 of an electrolytic cell with an electrolyte 2 in it. Immersed into the electrolyte is an anode 3 surrounded by a diaphragm 4 as well as a plurality of cathodes 5. The electrolyte is continuously fed, via a lateral inlet 8, in the direction of arrow 9 into vessel 1. It leaves the vessel via an overflow at the upper edge of the vessel or holes or other means there provided. A manifold, not shown, arranged on the bottom of the vessel provides for an even distribution of the electrolyte the direction of flow of which in the cell is indicated by arrow 10.

In order to explain the principle of the process according to the invention, the left side of FIG. 1 indicates that a plurality of agitating means 11, 12, 13, 14, 15 are provided in the direction of electrolytic flow 10. The lower-most agitator 11, which is provided near the electrolyte inlet is driven with a lower rpm speed while the uppermost agitator 15 in the vicinity of the outlet is driven by the highest rpm speed. The agitators provided therebetween are driven by a mean rotational speed such that the agitation of the electrolyte generated by the agitators increases in the direction of the electrolytic flow.

This figure is only meant to explain the principle of the process according to the invention. In practice, the increase so effected of the material transport coefficient will be accomplished in a different way, preferably by a vibrator 6. The vibrator is secured to the wall of the vessel 1, preferably in the upper area of the wall so that the sound waves generated by it have their greatest amplitude in the outlet area of the vessel. It is also possible to secure a plurality of vibrators 6, one over the other, on the wall of the vessel, where the uppermost vibrator has a greater amplitude than the lowermost of the vibrators.

Experiments have shown that the vibration of at least one of the walls of vessel 1 by means of these vibrators or by at least one of the vibrators is sufficient to obtain the desired effect. That means that one need not vibrate the whole electrolytic vessel as was the case in the prior art and where it was not possible to influence the material transport coefficient in the direction of the electrolytic flow either.

Further solutions have been indicated in the patent claims, for instance that electrodes 3 and/or 5 may be vibrated as well, and so on. It is common to all the principles that the vibrational energy introduced into the bath is greater in the area of the outlet than in the area of the inlet.

FIG. 1 also shows that vibrator 6 emits vibrations in the direction of arrow 7 which are substantially at right angles to the level of plates 3, 5.

Figure 2:
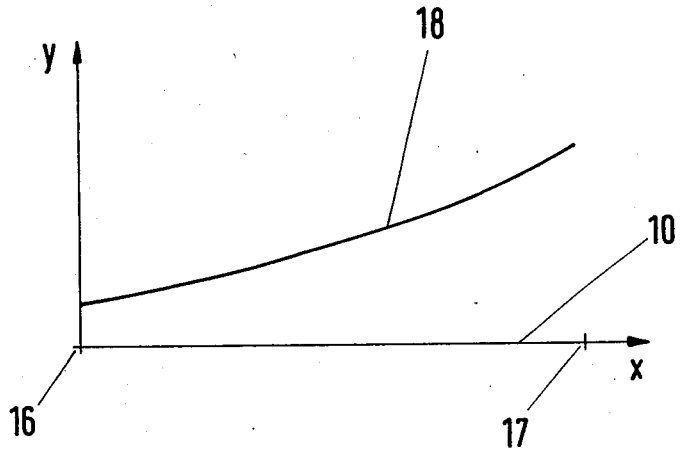
FIG. 2 is a diagram showing, as an example, the amplitude of the pressure waves employed over the length of the electrolytic cell in the direction of the electrolytic flow (corresponding to the height of the electrolytic cell of FIG. 1).

FIG. 2 shows, as a further explanation a diagram where the direction of electrolytic flow 10 is plotted as the abscissa x. As the ordinate y, the amplitudes of the mechanical vibrations acting on the electrolytic cell are plotted. This also shows that a smaller amplitude acts onto the electrolyte at inlet 16 of the electrolytic cell than at outlet 17. This is shown by curve 18.

What is claimed is:

1. An electrolytic process in which an electrolyte (2) is passed through an electrolytic cell (1) thus increasing the material transport coefficient by relative movement of electrodes and electrolyte within said electrolytic cell such that said electrolyte is subjected to pressure waves and characterized in that the increase of the material transport coefficient is greater along the direction (10) of the electrolytic flow by increasing the mechanical energy introduced in this direction.

2. A process according to claim 1, characterized in that said pressure waves to which said electrolyte is subjected are substantially expanding at right angles relative to the electrode faces arranged in parallel relative to each other.

3. A process according to claim 2, characterized in that the difference in the material transport coefficient along the direction of the electrolytic flow is obtained by a change of the amplitude of the pressure wave.

4. A process according to claim 3, characterized in that the amplitude of the pressure wave in the area of the cell outlet is larger by at least the factor 4 as compared to the area of the cell inlet.

5. A process according to claim 4, characterized in that the pressure wave is generated by one, or a plurality of, generators secured to the housing of the electrochemical cell.

6. A process according to claim 5, characterized in that the change of the amplitude of the pressure wave along the direction of the electrolytic flow is obtained by the provision of the vibrators and/or the structural shape of the cell housing.

7. A process according to claim 1, characterized in that the electro-chemical reaction takes place on a solid bed electrode.

* * * * *